US009255407B2

(12) United States Patent
Burgess

(10) Patent No.: US 9,255,407 B2
(45) Date of Patent: Feb. 9, 2016

(54) TRUSS SYSTEM

(75) Inventor: Rex Kelvin Burgess, Auburn (AU)

(73) Assignee: DANPAL, Kibbutz Dan (IL)

( * ) Notice: Subject to any disclaimer, the term of this patent is extended or adjusted under 35 U.S.C. 154(b) by 0 days.

(21) Appl. No.: 14/349,284

(22) PCT Filed: Aug. 15, 2012

(86) PCT No.: PCT/AU2012/000963

§ 371 (c)(1),
(2), (4) Date: Apr. 2, 2014

(87) PCT Pub. No.: WO2013/049878

PCT Pub. Date: Apr. 11, 2013

(65) Prior Publication Data

US 2014/0237920 A1 Aug. 28, 2014

(30) Foreign Application Priority Data

Oct. 5, 2011 (AU) ..... 2011232748

(51) Int. Cl.
*E04C 3/02* (2006.01)
*E04C 3/04* (2006.01)
(Continued)

(52) U.S. Cl.
CPC ..... *E04C 3/04* (2013.01); *E04B 1/2403* (2013.01); *E04B 7/08* (2013.01); *E04C 3/08* (2013.01); *E04C 3/10* (2013.01); *E04C 3/40* (2013.01); *E04D 3/06* (2013.01); *E04D 3/28* (2013.01); *E04B 2001/2409* (2013.01); *E04C 2003/0413* (2013.01); *E04C 2003/0417* (2013.01);
(Continued)

(58) Field of Classification Search
CPC ..... E04C 2003/0491; E04C 3/08; E04C 2003/0452; E04C 3/09; E04C 3/16; E04C 3/04; E04C 3/10; E04C 3/40; E04C 2003/0417; E04C 2003/0486; E04C 2003/0413; E04B 1/2403; E04B 7/08; E04B 2001/2409; E04D 3/06; E04D 3/28; E04D 2003/285
USPC ..... 52/694, 693, 729.4
See application file for complete search history.

(56) References Cited

U.S. PATENT DOCUMENTS 1,371,727 A * 3/1921 Blickle ..... 52/22
1,602,283 A * 10/1926 Coryell et al. ..... 52/693
(Continued)

FOREIGN PATENT DOCUMENTS

AT 002 947 U2 7/1999
GB 1 487 244 A 9/1977

OTHER PUBLICATIONS

Back to back. (n.d.). Dictionary.com Unabridged. Retrieved Jul. 23, 2015, from Dictionary.com website: http://dictionary.reference.com/browse/back to back.*
(Continued)

*Primary Examiner* — Basil Katcheves
*Assistant Examiner* — Joshua Ihezie
(74) *Attorney, Agent, or Firm* — Leydig, Voit & Mayer, Ltd.

(57) ABSTRACT

A truss system for roofing a building; a truss of said truss system including at least one truss segment; each said truss segment comprising a first elongate element and a second elongate element; said first and second elongate elements interconnected at intervals by a series of fish-plate assemblies; said fish-plate assemblies arranged in sliding engagement with respective extruded fish-plate channels of said first and second elongate elements.

16 Claims, 10 Drawing Sheets

(51) Int. Cl.

| | |
|---|---|
| ***E04C 3/40*** | (2006.01) |
| ***E04B 7/08*** | (2006.01) |
| ***E04C 3/08*** | (2006.01) |
| ***E04D 3/28*** | (2006.01) |
| ***E04C 3/10*** | (2006.01) |
| ***E04B 1/24*** | (2006.01) |
| ***E04D 3/06*** | (2006.01) |

(52) U.S. Cl.
CPC . *E04C2003/0452* (2013.01); *E04C 2003/0486* (2013.01); *E04D 2003/285* (2013.01)

(56) References Cited

U.S. PATENT DOCUMENTS

| | | | | | |
|---|---|---|---|---|---|
| 1,964,403 | A | * | 6/1934 | Loucks | 52/377 |
| 2,668,606 | A | * | 2/1954 | King | 52/693 |
| 3,043,408 | A | * | 7/1962 | Attwood | 52/842 |
| 3,221,467 | A | * | 12/1965 | Henkels | 52/690 |
| 3,461,636 | A | * | 8/1969 | Hern | 52/650.1 |
| 3,740,917 | A | * | 6/1973 | Wong | 52/694 |
| 3,786,548 | A | * | 1/1974 | Haskell | 29/897.35 |
| 3,960,637 | A | * | 6/1976 | Ostrow | 156/293 |
| 4,429,872 | A | * | 2/1984 | Capachi | 473/490 |
| 4,453,363 | A | * | 6/1984 | Koller | 52/481.1 |
| 4,485,597 | A | * | 12/1984 | Worrallo | 52/479 |
| 4,546,591 | A | * | 10/1985 | Beltz | 52/645 |
| 4,548,014 | A | * | 10/1985 | Knowles | 52/693 |
| 4,833,843 | A | * | 5/1989 | Richter | 52/81.4 |
| 4,890,429 | A | | 1/1990 | Gatzka et al. | |
| 4,937,998 | A | * | 7/1990 | Goldberg | 52/842 |
| 5,313,749 | A | * | 5/1994 | Conner | 52/223.12 |
| 5,437,136 | A | * | 8/1995 | Triebel | 52/693 |
| 5,509,250 | A | * | 4/1996 | Jensen et al. | 52/200 |
| 5,660,492 | A | * | 8/1997 | Bathon | 403/267 |
| 6,922,969 | B1 | * | 8/2005 | Mina | 52/841 |
| 8,065,848 | B2 | * | 11/2011 | Carlson et al. | 52/309.16 |
| 8,132,776 | B2 | * | 3/2012 | Sladojevic | 249/139 |
| 8,322,037 | B2 | * | 12/2012 | Carlson et al. | 29/897.3 |
| 8,607,528 | B2 | * | 12/2013 | Ellen | 52/745.19 |
| 2002/0007611 | A1 | * | 1/2002 | Sanford et al. | 52/694 |
| 2004/0062915 | A1 | * | 4/2004 | Pabedinskas et al. | 428/188 |
| 2004/0219357 | A1 | * | 11/2004 | Van Dijk et al. | 428/357 |
| 2006/0032182 | A1 | * | 2/2006 | Carlson et al. | 52/729.1 |
| 2008/0209832 | A1 | * | 9/2008 | Near | 52/481.1 |
| 2008/0245025 | A1 | | 10/2008 | Slater et al. | |
| 2008/0250747 | A1 | * | 10/2008 | Johnson et al. | 52/693 |
| 2010/0257810 | A1 | * | 10/2010 | Ollman | 52/645 |
| 2011/0209947 | A1 | * | 9/2011 | Allred et al. | 182/194 |
| 2014/0117190 | A1 | * | 5/2014 | Werner et al. | 248/346.03 |

OTHER PUBLICATIONS

Australian Patent Office, International Search Report in International Application No. PCT/AU2012/000963 (Nov. 23, 2012).

Australian Patent Office, International Preliminary Report on Patentability in International Application No. PCT/AU2012/000963 (Feb. 6, 2013).

* cited by examiner

TRUSS SYSTEM

CROSS-REFERENCE TO RELATED APPLICATIONS

This patent application is the U.S. national phase of International Application No. PCT/AU2012/000963, filed on Aug. 15, 2012, which claims the benefit of Australian Patent Application No. 2011232748, filed Oct. 5, 2011, the disclosures of which are incorporated by reference.

TECHNICAL FIELD

The present invention relates to building structures and, more particularly, to roof truss, roof panelling and curtain wall systems.

BACKGROUND

The covering of outdoor and indoor areas, as well as building facades, with light transmitting materials is well known, and polymer, typically polycarbonate sheeting or panels for this purpose, are in common use. A range of materials and configurations of supporting members are used to span the area or facade required to be covered. Conventional systems rely on framing, typically, in the case of roof structures, comprising sloping rafters with regular arrays of transverse purlins, the latter providing both stabilising elements and support for the polymer sheeting.

To span relatively large areas, such as sporting venues for example, requires large and heavy structural timber or steel trusses, adding considerably to the cost of the roof structure.

The use of timber or steel trusses with the added array of purlins is often undesirable from an aesthetic point of view, and in some environments, such as indoor swimming pools for example, these structural elements can be subject to corrosion and deterioration.

It is an object of the present invention to address or at least ameliorate some of the above disadvantages.

Notes

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

The term "fish plate" as used in this specification indicates a plate for interconnecting two structural elements, either through interlocking elements or by means of fasteners.

BRIEF DESCRIPTION OF INVENTION

Accordingly, in one broad form of the invention, there is provided a truss system for roof or façade panelling of a building; a truss of said truss system including at least one truss segment; each said truss segment comprising a first elongate element and a second elongate element; said first and second elongate elements interconnected at intervals by a series of fish-plate assemblies; each fish-plate assembly of said series of fish-plate assemblies comprising a pair of fish-plates arranged back-to-back when in use; each fish-plate comprising a planar plate portion provided at respective upper and lower edges with flanges projecting outwardly and normal to an outer surface of said planar plate portion; said fish-plate assemblies engaging with respective extruded fish-plate channels of said first and second elongate elements; said fish-plate channels formed so as to retain said fish-plate assemblies by capture of said flanges when said pair of fish-plates are assembled back-to-back.

Preferably, each said first and second elongate element of a said truss segment comprises an extruded section; said extruded section including a panel retaining channel and said extruded fish-plate channel.

Preferably, a said extruded section further includes a connector plate slot; said connector blade slot adapted for friction fit insertion of a connector plate.

Preferably, a said extruded section further includes a cable channel; said cable channel adapted to receive a free-running tensioning cable.

Preferably, said panel retaining channel includes panel retaining elements; said panel retaining elements formed along outer edges of said panel retaining channel; said panel retaining elements directed inwards towards a median plane of said panel retaining channel.

Preferably, a said truss supports said panels by retaining flange elements of said panels in said panel retaining channels; said panel retaining elements locking respective said flange elements of adjacent said panels into said panel retaining channel as a snap fit.

Preferably, a said truss supports said panels along said first elongate elements of said truss.

Preferably, a said truss supports said panels along said second elongate element of said truss.

Preferably, a said truss supports said panels along both said first and said second elongate elements of said truss.

Preferably, said panels interconnect adjacent ones of said trusses; said panels fulfilling the function of purlins.

Preferably, said first and second elongate elements of said truss comprise aluminium extrusions.

Preferably, fish-plates of said fish-plate assemblies comprise stainless steel pressings.

Preferably, said tensioning cable comprises stainless steel wire rope.

Preferably, said panels comprise transparent or translucent polymer panels.

Preferably, translucent insulating panels are retained between said panels arranged along both said first and said second elongate elements of said truss.

In another broad form of the invention, there is provided a method of providing roofing or curtain walling of a building or area; said method including assembly and erection of trusses; said method including the steps of:

(a) assembling a required number of truss segments into said trusses; each said segment comprising a first and a second elongate element, (b) interconnecting said first and second elongate elements of each said segment with at least one fish-plate assembly; fish-plates of said at least one fish-plate assembly engaging with respective fish-plate channels of said first and second elongate elements;

(c) connecting abutting ones of said required number of truss segments by insertion of connector plates into connector plate slots of said abutting truss segments, (d) passing tensioning cables through cable channels of said first and second elongate elements of said abutting truss segments, (e) tensioning said tensioning cables, and wherein each fish-plate assembly comprises a pair of fish-plates arranged back to back when in use; each said fish-plate comprising a planar plate portion provided at respective upper and lower edges with flanges projecting outwardly and normal to an outer surface of said planar plate portion; said flanges captured in fish-plate channels provided in each of said first and second elongate element.

Preferably, said method further includes the steps of:

(a) erecting said trusses on suitable supporting elements at predetermined intervals, (b) snap-fitting panels into panel retaining channels of either or both of elongate first and second elements of adjacent said truss segments.

Preferably, insulating panels are retained between said panels attached to both said first and second elements.

In another broad form of the invention, there is provided a truss system for roof or façade panelling of a building; a truss of said truss system including at least one truss segment; each said truss segment comprising a first elongate element and a second elongate element interconnected at intervals by one or more short fish-plate assemblies; each said short fish-plate assembly comprising a pair of fish-plates arranged back-to-back when in use; said fish-plate assemblies engaging with respective extruded fish-plate channels of said first and second elongate elements; each said fish-plate comprising a planar plate portion provided at respective upper and lower edges with flanges projecting outwardly and normal to an outer surface of said planar plate portion; said flanges captured in said fish-plate channels, and wherein abutting truss segments are connected together by means of a long fish-plate assembly.

Preferably, said long fish-plate assembly comprises a back-to-back assembly of two long fish-plates; each said long fish-plate comprising a central section; said long fish-plate assemblies including extension arms extending from upper and lower portions of said central section; said central section and said extension arms provided with respective upper and lower series of through holes.

Preferably, said central section is provided with outwardly projecting flange elements at an upper edge and a lower edge of said central section such that when said long fish-plates are assembled in said back to back assembly said outwardly projecting flange elements project outwardly from said assembly.

Preferably, said outwardly projecting flange elements engage with said extruded fish-plate channels of said first and second elongate elements.

Preferably, half of a length of a said long fish-plate assembly is secured in said extruded fish-plate channels of a first said truss segments by bolts passing through flange elements of said first and second elongate elements and said through holes; a second half of said length of said long fish-plate assembly secured in said fish-plate channels of an adjoining said truss segment by bolts passing through flange elements of said first and second elongate elements and said through holes.

In another broad form of the invention, there is provided a method of securing together adjoining segments of a truss; each said truss segment comprising first and second elongate elements interconnected by short fish-plate assemblies; each of said short fish-plate assemblies comprising a pair of short fish-plates arranged back to back when in use; each of said short fish-plates comprising a planar plate portion provided at respective upper and lower edges with flanges projecting outwardly and normal to an outer surface of said planar plate portion; said fish-plates retained in said fish-plate channels by capture of said flanges in said fish-plate channels, said method including the steps of:

(a) inserting a first pair of extension arms projecting from a central portion of a long fish-plate assembly into fish-plate channels of respective first and second elongate elements of a first said truss segment, (b) securing said long fish-plate assembly in said first and second elongate elements by bolts passing through flanges of said elongate elements and through holes in said extension arms and in said central portion of said fish-plate assembly, (c) sliding first and second elongate elements of a said adjoining truss segment onto an opposite second pair of extension arms of said long fish-plate assembly so as to abut corresponding said first and second elongate elements of said first truss segment, (d) securing said adjoining truss segment to said long fish-plate assembly by bolts passing through flanges of said elongate elements and through holes in said extension arms and said central portion of said fish-plate assembly, and wherein a said long fish-plate assembly comprises a pair of said long fish-plates arranged back-to-back; said long fish-plates including a central portion with extension arms projecting from upper and lower extremities of said central portion; at least said central portion provided along respective upper and lower edges with flanges projecting outwardly and normal to an outer surface of said planar plate portion; said long fish-plates retained in said fish-plate channels by said flanges captured in said fish-plate channels.

In another broad form of the invention there is provided a method of assembling fish-plate assemblies to elongate elements of a truss; said truss comprising first and second elongate elements interconnected by a series of said fish-plate assemblies; each said fish-plate assembly comprising a pair of fish-plates arranged in a back-to-back position when in use; said method including the steps of:

a. inserting first and second fish-plates of each of said series of fish-plate assemblies into a narrow part of a fish-plate channels provided in said first and second elongate element, b. sliding said first and second fish-plates together into said back-to-back position, and wherein each said fish-plate includes a planar plate portion provided along respective upper and lower edges with flanges projecting outwardly from an outer surface of said planar plate portion; said fish-plate channels of sufficient width for insertion of said fish-plates; said fish-plate assembly retained in said in said fish-plate channels by captured of said flanges in said fish-plate channels when said pair of fish-plates are assembled in said back-to-back position.

BRIEF DESCRIPTION OF DRAWINGS

Embodiments of the present invention will now be described with reference to the accompanying drawings wherein.

DETAILED DESCRIPTION OF PREFERRED EMBODIMENTS

First Preferred Embodiment

Figure 1:
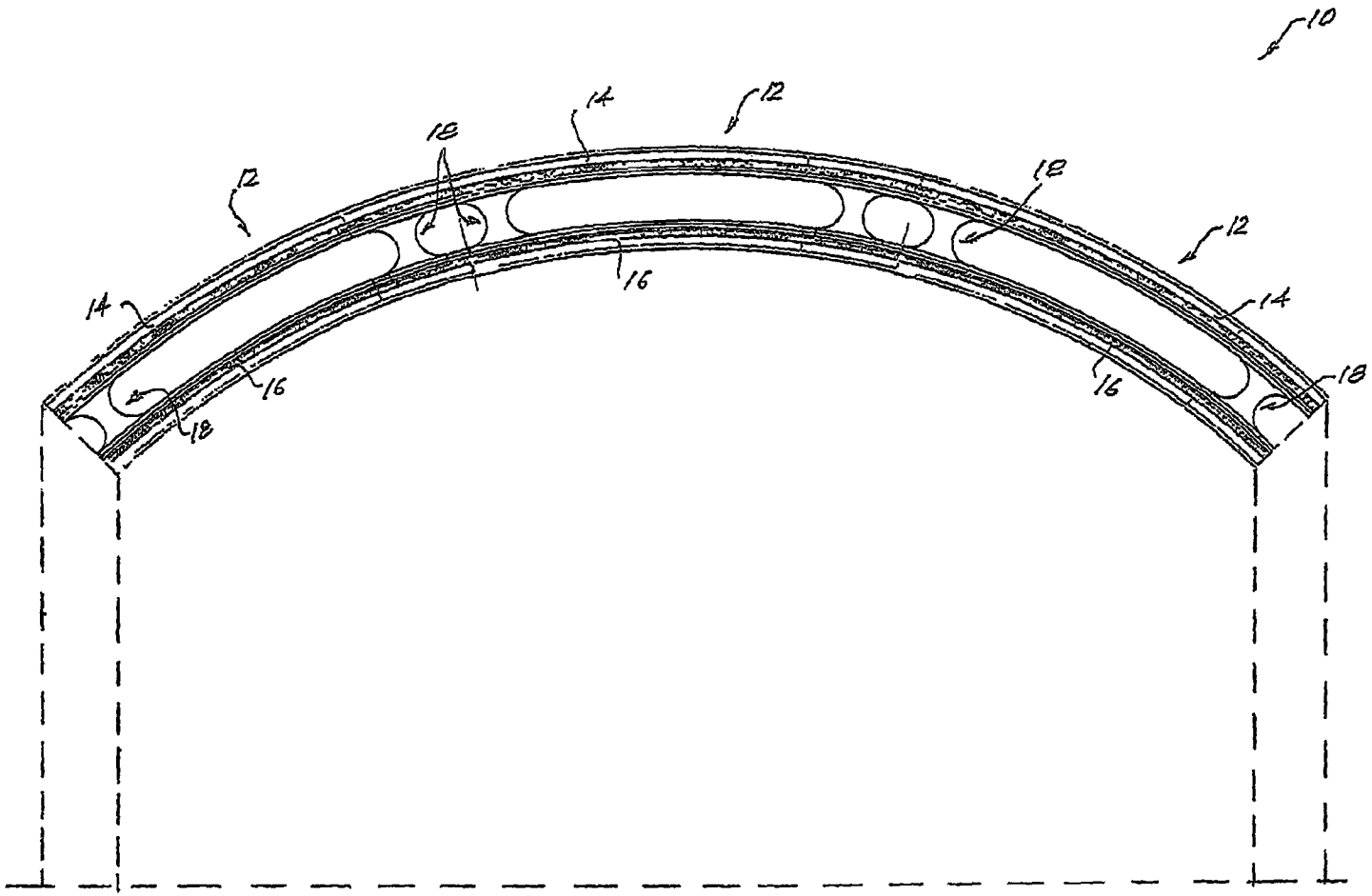
FIG. 1, is a side view of an exemplary truss according to a preferred embodiment of the invention.

With reference to FIG. 1, the truss system of the present invention comprises a truss (10) formed of one or more arched truss segments (12) which may be interconnected together to form the truss (10) for support of roofing over a building (not shown) or area, or, when in straight, non arched sections, form the support for a curtain wall.

Each of the truss segments (12) comprises a first elongate element (14) and a second elongate element (16), which are interconnected at intervals by a series of fish-plate assemblies (18). As can be seen in FIGS. 2 to 5, fish-plate assemblies (18) are assembled in sliding engagement with respective extruded fish-plate channels (20) respectively of the first and second elongate elements, (14) and (16).

Figure 3:
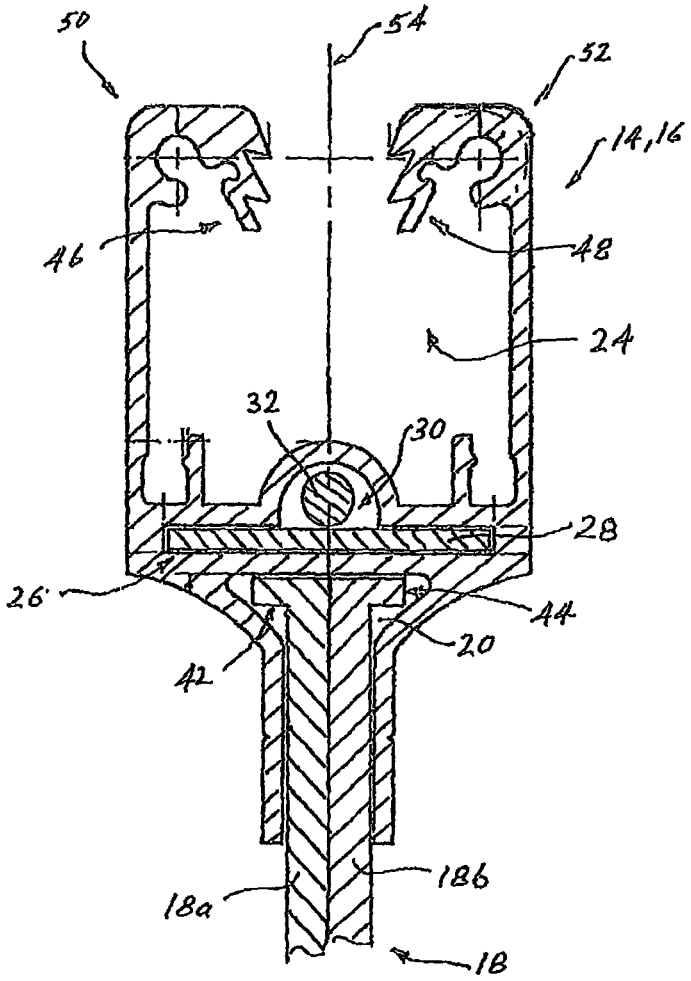
FIG. 3 is an end view of an extrusion forming first and second elongate elements of a truss segment.
Figure 4:
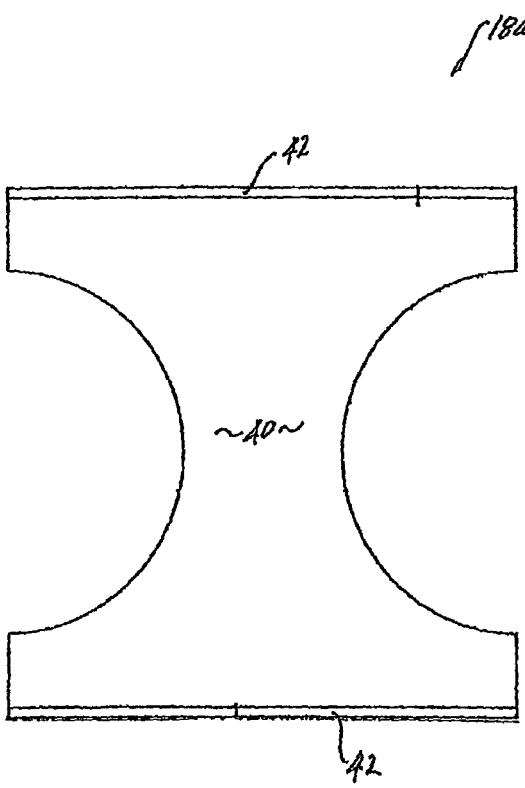
FIGS. 4 and 5 are side and end views respectively of one of a pair of fish-plate components of the truss system.
Figure 5:
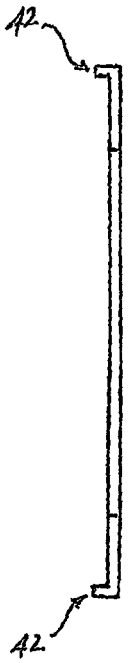

Preferably, as best seen in FIG. 3, each of the first and second elongate elements (14) and (16) of a truss segment (12), comprises an identical extruded aluminium section which includes a roof (or wall) panel retaining channel (24), as well as the fish-plate channel (20). Depending on the application, the truss elements (14) and (16) may be straight for relatively short spans or curtain walls, or curved to span large roof or covered areas as shown in FIG. 1.

The extruded section of the elongate elements (14) and (16) further includes a connector plate slot (26) which is adapted for friction fit insertion of a connector plate (28). Also included in each extruded section is a cable channel (30) which is adapted to receive a free-running tensioning cable (32).

With reference to FIGS. 2 to 5, each of the fish-plate assemblies (18) in the series of fish-plate assemblies of a truss segment (12), comprises a pair of fish-plates, (18*a*,18*b*), arranged back-to-back when assembled to the first and second elongate extruded elements (14,16). Each fish-plate (18*a*, 18*b*) of the paired fish-plates comprises a planar plate portion (40) which is provided at its respective upper and lower edges with identical flanges (42,44), which project outwardly and normal to the outer surface of the planar plate portion (40).

Figure 2:
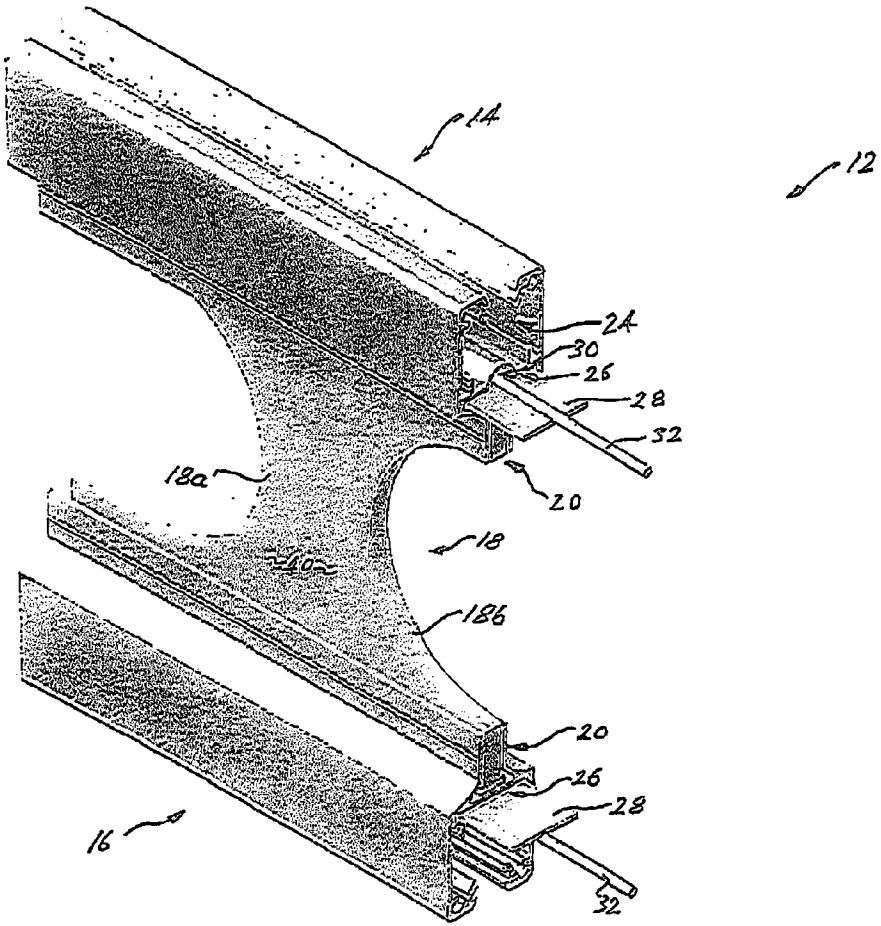
FIG. 2 is a perspective view of portion of a truss segment of the truss of FIG. 1.

As can be seen from FIGS. 2 and 3, the fish-plate channel (20) is so formed as to retain the fish-plate assembly (18) of fish-plates (18*a*,18*b*) by capture of the flanges (42,44) when both are located back-to-back in the channel (20). The inner, that is, the narrow part of the fish-plate channel is of a width sufficient to allow insertion of the first of the pair of fish-plates. The second of the pair may also be inserted into the opposing channels adjacent to the first fish-plate. The pair may then be slid together into the back-to-back position shown in FIG. 2, to complete the fish-plate assembly.

It will be understood that the fish-plates may be made in a range of sizes so as to adapt the depth of the truss to suit the required span, wind load factors and other design parameters.

Preferably, both the connector plates (28) and the pairs of fish-plates (18*a*,18*b*) are of stainless steel, with the tensioning cables (32) also of stainless steel.

Figure 6:
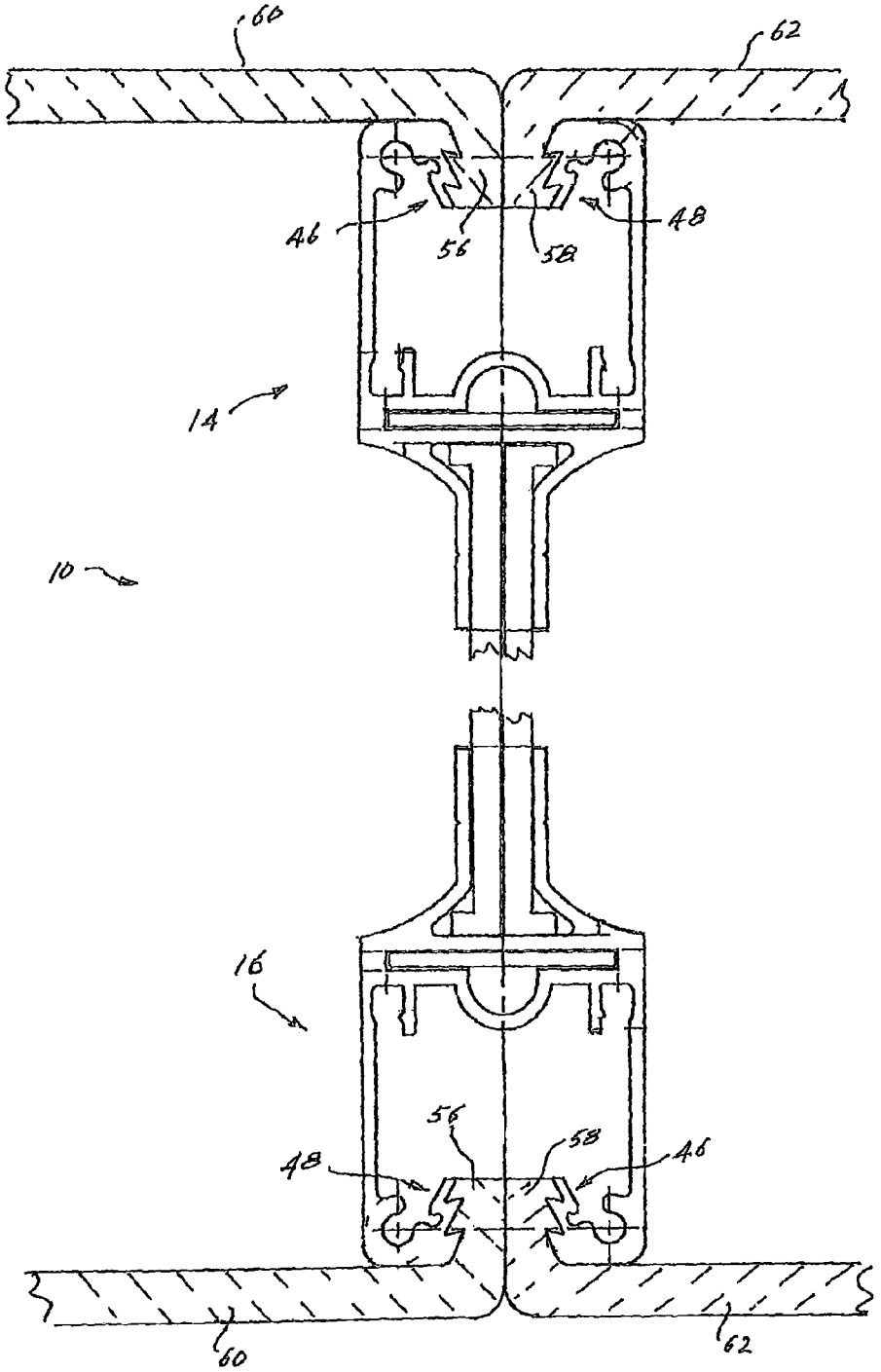
FIG. 6 is a sectioned view of a portion of a roof formed with the truss system of the invention.

As best seen in FIGS. 3 and 6, the roof (or wall) panel retaining channel (24) includes panel retaining elements (46, 48) formed along the outer edges (50,52) of the panel retaining channel (24). These panel retaining elements (46,48) are directed inwards towards the median plane (54) of the panel retaining channel, and are formed to allow insertion of retaining flange elements (56,58) of adjacent panels (60,62) into the panel retaining channel (24) as shown in FIG. 6. The panel retaining elements (46,48) lock the respective flange elements (56,58) of the adjacent panels (60,62) into the panel retaining channel as a snap fit.

As can also be seen from FIG. 6, the truss (10) may support panels (60,62) along the upper of the two elongate elements (14) of the truss in a roofing application of the invention. Alternatively, or in addition, panels (60,62) may be supported along the lower elongate elements (16). In the former case, the close abutment between the adjacent panels provides for a continuous cover over the truss (10) when viewed from above (or from outside in the case of a curtain wall). Similarly, panels supported by the lower elongate elements (14) completely cover the truss (10) when viewed from below (or from inside).

In Use

The panels adapted for use with the truss system of the invention, may be of metal, but are preferably of opaque or translucent polymer, more preferably polycarbonate, sheeting provided with the edge flanges suited to engagement with the panel retaining channels of the truss.

For large spans, the aluminium extrusions of the first and second elements of the truss segments may be roll formed into an arcuate form so that when the segments are assembled, the truss forms an arch over the building or area to be covered.

To assemble a truss, firstly the required number of truss segments is assembled. This is effected by placing the first and second elongate elements of each truss segment side by side with the fish-plate channels facing each other. The first fish-plates of the series of fish-plate assemblies for that truss segment are then placed into the opposing channels. At this stage the first and second elongate elements are not locked together and the corresponding second fish-plates of each back-to-back pair may also be inserted into the opposing channels adjacent their opposite plates.

The second fish-plates are then slid into their back-to-back positions to complete the fish-plate assemblies and lock the first and second elongate elements together, as the retaining flange elements then lock into the fish-plate channels. Assemblies may be secured in position by riveting for example through the parallel sides of the fish-plate channel.

A major advantage of the fish-plate assemblies is that, unlike bolted connections between first and second elements of a truss, there are no stress points at bolt hole locations. The load is transferred between the first and second elongate elements of the truss system of the invention and is spread over the considerable length of the flange elements of the fish-plates. Connector plates are driven into the connector plate slots at that end of the truss segment to be joined to the next truss segment and the two segments forced into abutment. This process is repeated until the required number of truss segments has been connected together. Tensioning cables are then fed through the tensioning channels and tensioned by means of swage studs (not shown) at each end of the truss to secure the truss into a load bearing unit.

In the case of roofing, trusses are lifted into position on suitable supporting elements at predetermined spacings.

Roofing panels are then snap-fitted into the roof panel retaining channels of either or both of elongate first and second elements of adjacent trusses. The roof panels of the system interconnect adjacent ones of the trusses, and the structural properties of the polycarbonate panels of the system are such that no other support is required than that provided by the trusses, with the panels in effect fulfilling the function of purlins.

Figure 7:
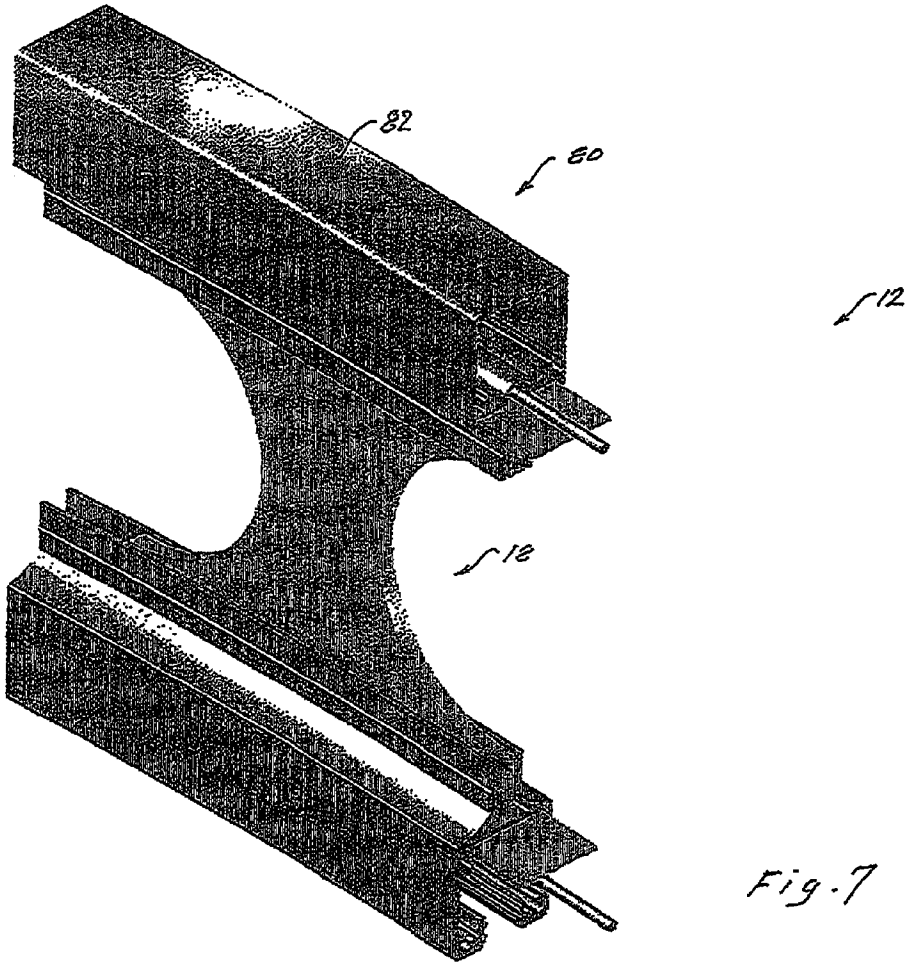
FIG. 7 is a perspective view of a portion of a truss segment in which one of first and second elongate elements includes an enclosed section.
Figure 8:
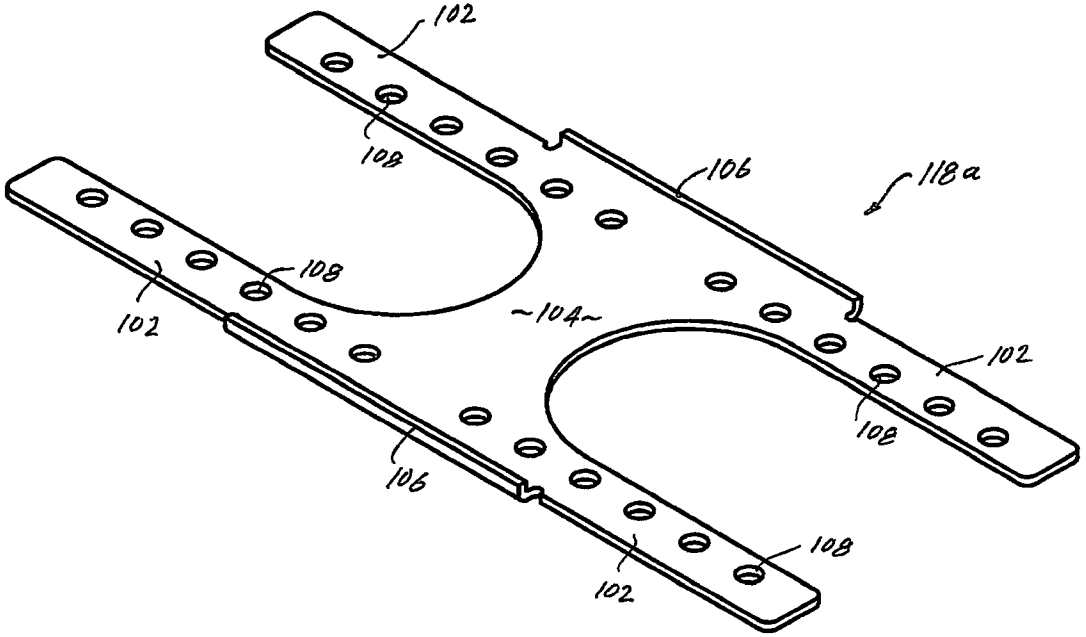
FIG. 8 is a side view of one of a pair of fish plate components according to a second preferred embodiment of the invention.

The system of the invention thus offers three glazing solutions. Firstly, in a roof construction, polycarbonate roofing panels may be arranged at the upper elongate elements of the truss only, providing a continuous glazed surface over the roof with the trusses exposed from below. Alternatively, roofing panels may be arranged at the lower elongate elements only, providing a continuous glazed surface as viewed from below, leaving the trusses exposed above, while thirdly, panels may be provided at both the upper and lower elongate elements of the trusses. Where both an upper and a lower layer of roofing panels are to be supported by the trusses, the lower layer is installed first and may be followed by placing translucent insulation bats to substantially fill the space between the upper and lower roofing panels. Alternatively, as shown in FIG. 7, where only a single layer of panels is required, a modified elongate element 80 with an enclosed section 82 may be used as either the first or second elongate element.

It will be appreciated, especially from FIG. 6, that the closely abutting polycarbonate panels of the lower layer effectively protect the trusses from any corrosive gasses, such as are present in an enclosed swimming pool for example. Similarly an upper layer of panels protect the trusses from the elements.

Second Preferred Embodiment

In this second embodiment with reference to FIGS. 8 to 11, in which like features are similarly numbered, truss segments (112) to made up a truss such as shown in FIG. 1, are likewise made up of first and second elongate elements (114) and (116) interconnected at intervals by assemblies of pairs of fish plates 18 (hereinafter referred to as "short fish plates") as described above and shown in FIGS. 2, 4 and 5. In this embodiment however, with reference firstly to FIG. 8, a second form of fish plates 118*a* and 118*b* ("long fish plates") of a modified configuration are provided in which extension arms 102 project from the upper and lower extremities of the central portion (104) of the plate.

Only the central portion (104) of each long fish plate (118*a*) and (118*b*) is provided with outwardly projecting flanges (106), (as described for the first embodiment above), at the upper and lower edged of the plate. A series of through holes 108 is provided along the upper and lower portions of the fish plate and along the extension arms 102. If required, depending on the degree of curvature of the elongate elements of the truss to which they are to be applied, the long fish plates may be provided with matching curvature.

Figure 9:
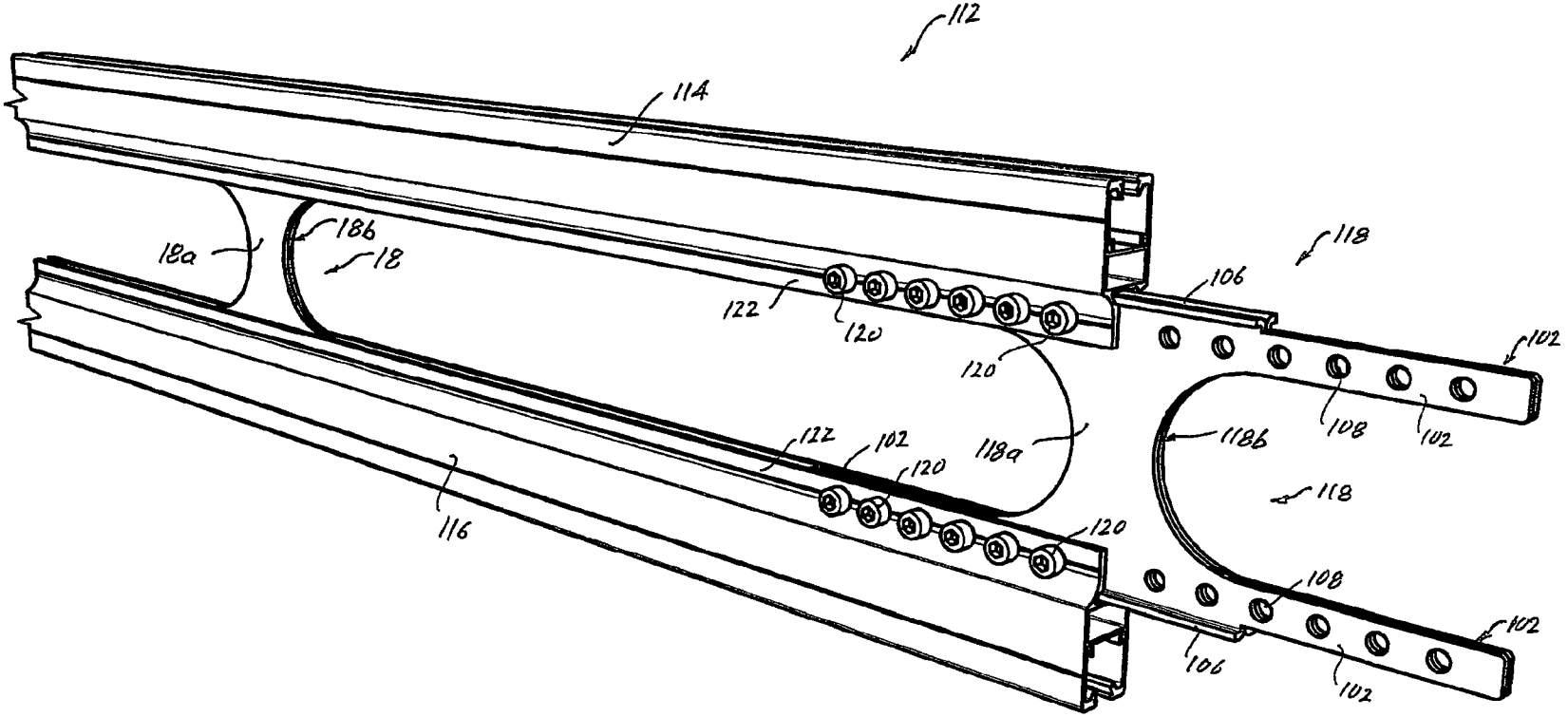
FIG. 9 is a perspective view of a pair of fish plates of FIG. 8 assembled to the ends of extrusions forming first and second elongate elements of a portion of a truss segment.

In this embodiment, with reference now to FIG. 9 the short fish plates (18*a*) and (18*b*) are again inserted and slid into back-to-back association to form fish plate assemblies (18) as before described, to interconnect the elements (114) and (116) of a truss segment (112) at intervals along the segment as required. However, in this embodiment the long fish plate assemblies 118 provide connections between adjoining truss segments.

To join prior assembled truss segments one to another, a long fish plate assembly (118) is inserted into the ends of first and second elongate elements (114) and (116) at the end of one of the two truss segments to be joined. The long fish plate assembly (118) is inserted to half its length as shown in FIG. 9 and the long fish plates then locked to the elongate elements (114) and (116) by through bolts (120) passing through pre-drilled holes, (or after drilling the required holes), through flanges (122) and the holes (108) in extension arms (102) of the long fish plate assembly (118).

The truss segment to be connected (without a long fish plate assembly inserted into the abutting ends of its elongate elements) may then be slid over the projecting sections of the long fish plate assembly (118) projecting from the prepared truss segment and the two segments secured together by similarly bolting through the flanges (120) and the opposite extension arms (102) of the long fish plates.

The extruded elongate elements (114) and (116) making up the first and second truss elements of a truss segment (112) may be of the same profile as described above and shown in FIGS. 3 and 6. Alternatively, truss segments may be formed with elongate element extrusions shown in FIGS. 10 and 11.

Figure 10:
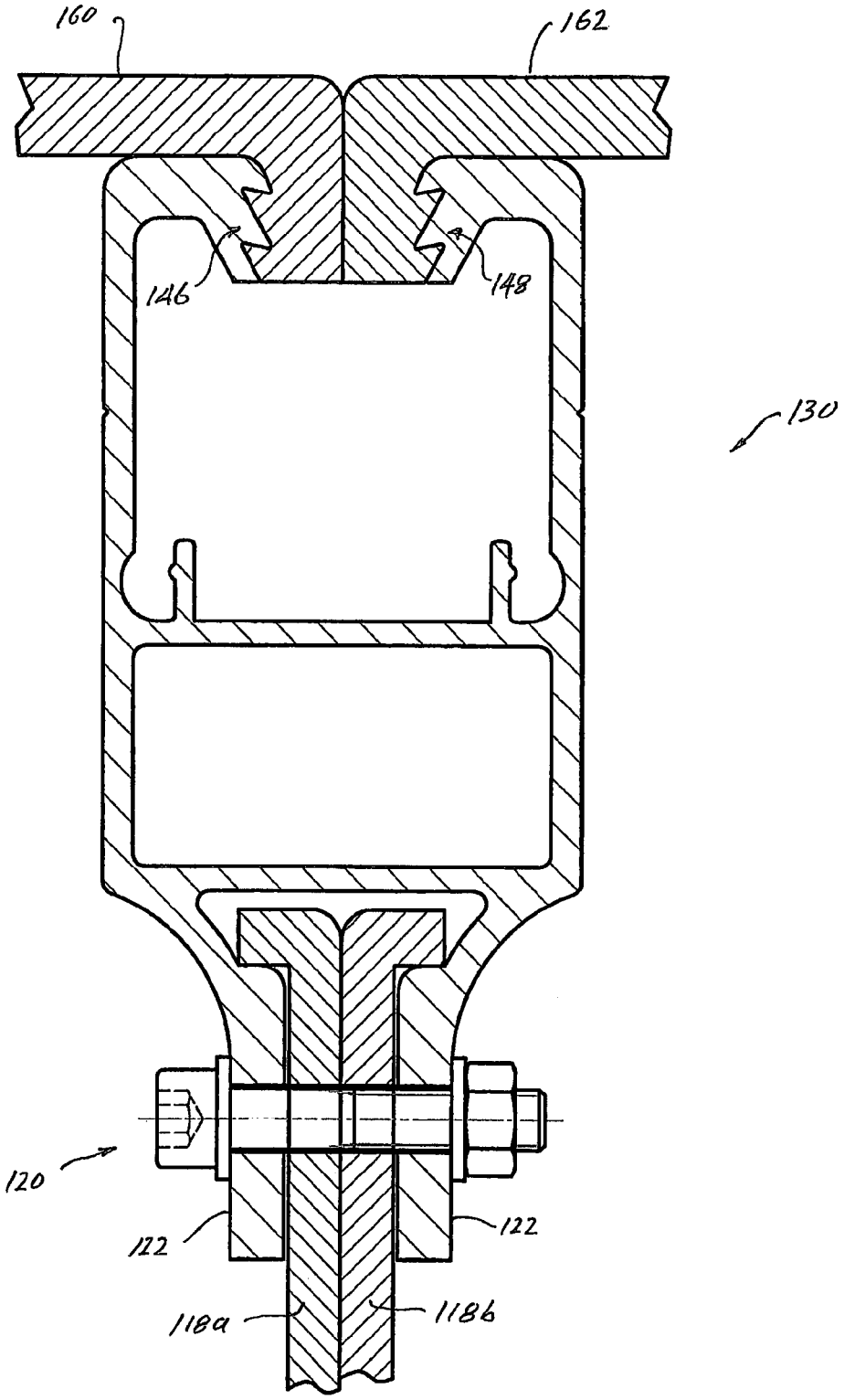
FIGS. 10 and 11 are end views of alternative extrusions forming either one of the elongate elements forming a truss segment.

In the case of the extrusion (130) of FIG. 10, the outer portion of the extrusion is provided with a channel structure and snap-in formations to accept the edges of polycarbonate panels as described above and as shown in FIG. 6. The overall depth of the profile of the extrusion (130) may be selected to suit the load requirements of a particular range of spans for which assembled trusses may be used.

Figure 11:
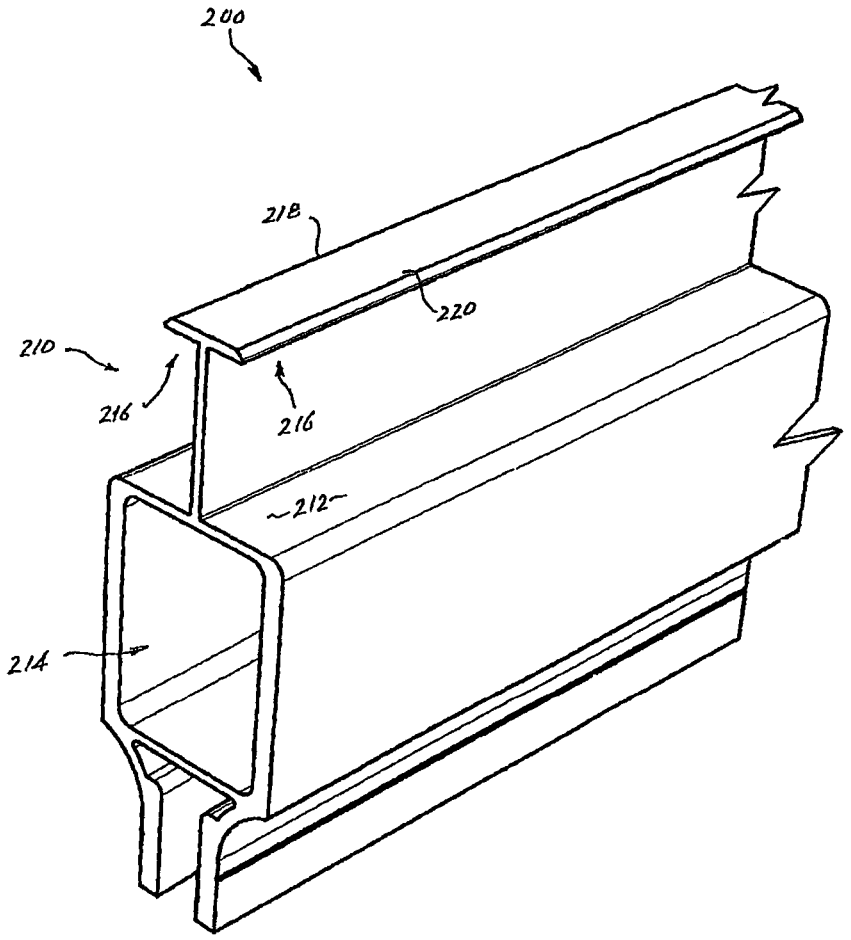

In an alternative arrangement as shown in FIG. 11, the extrusion (200) making up the first and second elements of a truss segment, may included a panel retaining formation in the form of a projected element (210) in the form of a "T" extending outward from an upper surface of a hollow section (214). In this arrangement, panels (not shown) are retained between the undersides (216) of the flanges (218) and (220) of the "T" section.

Although the above description is mainly focused on the use of the trusses in a roofing context, it will be understood that extensive facades may be provided with a translucent or transparent curtain wall by use of the truss assemblies of the invention arranged in vertical or sloping arrays and similarly combined with panels.

The above describes only some embodiments of the present invention and modifications, obvious to those skilled in the art, can be made thereto without departing from the scope of the present invention.

The invention claimed is:

1. A truss system for roof or façade panels of a building; a truss of said truss system including at least one truss segment; each said truss segment comprising a first elongate element and a second elongate element; said first and second elongate elements interconnected at intervals by a series of fish-plate assemblies; each fish-plate assembly of said series of fish-plate assemblies comprising a pair of fish-plates arranged back-to-back and touching each other when in use; each fish-plate comprising a planar plate portion provided at respective upper and lower edges with flanges projecting outwardly and normal to an outer surface of said planar plate portion; each of said fish-plates engaging at opposite ends with respective extruded fish-plate channels of said first and second elongate elements; said fish-plate channels formed so as to retain said fish-plate assemblies by capture of said flanges when said pair of fish-plates are assembled back-to-back; and wherein each said first and second elongate element of a said truss segment comprises an extruded section; said extruded section including a panel retaining channel and said extruded fish-plate channel; and comprising an interconnected pair of said truss segments wherein the respective extruded section of each truss segment further includes a connector plate slot; the respective connector plate slots of the pair of truss segments adapted for friction fit insertion of a connector plate for interconnecting the pair of truss segments; and wherein said panel retaining channel includes panel retaining elements; said panel retaining elements formed along outer edges of said panel retaining channel; said panel retaining elements directed inwards towards a median plane of said panel retaining channel.

2. The truss system of claim 1, wherein a said extruded section further includes a cable channel; said cable channel adapted to receive a free-running tensioning cable.

3. The truss system of claim 2, wherein said tensioning cable comprises stainless steel wire rope.

4. The truss system of claim 1, comprising a pair of adjacent panels, each adjacent panel having a retaining flange element, and wherein a said truss supports said retaining flange elements in said panel retaining channels; said panel retaining elements locking respective said flange elements of the adjacent panels into said panel retaining channel as a snap fit.

5. The truss system of claim 1, wherein a said truss supports said panels along said first or second elongate elements of said truss or along both said first and second elongate elements of said truss.

6. The truss system of claim 1, wherein said panels interconnect adjacent ones of said trusses; said panels fulfilling the function of purlins.

7. The truss system of claim 1, wherein said first and second elongate elements of said truss comprise aluminum extrusions.

8. The truss system of claim 1, wherein fish-plates of said fish-plate assemblies comprise stainless steel pressings.

9. The truss system of claim 1, wherein said panels comprise transparent or translucent polymer panels.

10. The truss system according to claim 1, wherein:

the series of fish-plate assemblies includes one or more short fish-plate assemblies;

the flanges are captured in said fish-plate channels; and abutting truss segments are connected together by means of a long fish-plate assembly.

11. The truss system of claim 10, wherein said long fish-plate assembly comprises a back-to-back assembly of two long fish-plates; each said long fish-plate comprising a central section; said long fish-plate assemblies including extension arms extending from upper and lower portions of said central section; said central section and said extension arms provided with respective upper and lower series of through holes.

12. The truss system of claim 11, wherein said central section is provided with outwardly projecting flange elements at an upper edge and a lower edge of said central section such that when said long fish-plates are assembled in said back to back assembly said outwardly projecting flange elements project outwardly from said assembly.

13. The truss system of claim 11, wherein said outwardly projecting flange elements engage with said extruded fish-plate channels of said first and second elongate elements.

14. The truss system of claim 11, wherein half of a length of a said long fish-plate assembly is secured in said extruded fish-plate channels of a first said truss segments by bolts passing through flange elements of said first and second elongate elements and said through holes; a second half of said length of said long fish-plate assembly secured in said fish-plate channels of an adjoining said truss segment by bolts passing through flange elements of said first and second elongate elements and said through holes.

15. The truss system of claim 1, wherein each of the fish-plate channels projects outwardly from an outer surface of the respective first and second elongate elements.

16. The truss system of claim 15, wherein the fish-plate channels are formed so as to frictionally retain the fish-plate assemblies without requiring bolts.

* * * * *